US005911211A

United States Patent [19]

Uchida

[11] Patent Number: 5,911,211

[45] Date of Patent: Jun. 15, 1999

[54] SUPERCHARGED ENGINE

[75] Inventor: Masahiro Uchida, Iwata, Japan

[73] Assignee: Yamaha Hatsudoki Kabushiki Kaisha, Iwata, Japan

[21] Appl. No.: 08/779,963

[22] Filed: Dec. 23, 1996

[30] Foreign Application Priority Data

Dec. 28, 1995 [JP] Japan ..... 7-343902

[51] Int. Cl.[6] ..... F02B 33/44

[52] U.S. Cl. ..... 123/559.1

[58] Field of Search ..... 123/198 R, 559.1

[56] References Cited

U.S. PATENT DOCUMENTS 1,625,597 4/1927 Fornaca ..... 123/559.1
4,932,368 6/1990 Abe et al. ..... 123/559.1
4,951,638 8/1990 Tsuboi et al. ..... 123/559.1
5,060,622 10/1991 Suzuki .
5,143,028 9/1992 Takahashi .
5,392,751 2/1995 Matsubara et al. ..... 123/559.1
5,433,180 7/1995 Hitomi et al. ..... 123/559.1

*Primary Examiner*—Michael Koczo
*Attorney, Agent, or Firm*—Knobbe, Martens, Olsen & Bear LLP

[57] ABSTRACT

A "V"-type engine having two banks of cylinders with a valley therebetween, an intake air manifold extending between the banks, and a supercharger for charging the air delivered to the engine is disclosed. The supercharger is positioned in the valley formed between the two banks of cylinders and below the intake air manifold. The supercharger has an air inlet and an air outlet, the air outlet extending upwardly to the intake air manifold.

3 Claims, 7 Drawing Sheets

SUPERCHARGED ENGINE

FIELD OF THE INVENTION

The present invention relates to a supercharged engine. More particularly, the present invention is a "V"-type engine having a supercharger positioned between the cylinder banks thereof and below the intake manifold.

BACKGROUND OF THE INVENTION

One means for increasing the performance of an internal combustion engine is to increase the volume of air supplied to the combustion chambers thereof. Superchargers are one well known means for accomplishing this. Superchargers compress an incoming air charge and supply it to the combustion chambers of the engine. The resultant air charge supplied to the engine has a higher density, resulting in greater power output upon combustion.

Typically, superchargers are positioned at the end of the engine, below the engine, or on top of the intake manifold above the engine. Each of these configurations greatly increases the overall profile of the engine. For example, if the supercharger is positioned at the front or rear ends of the engine, the overall length of the engine is increased. This is generally unacceptable when the engine is mounted in transverse fashion within an automobile engine compartment or in an outboard motor cowling, as the length of the engine may exceed the maximum length of the compartment.

The supercharger may also be placed below the engine, but this has the disadvantage of increasing the "height" of the engine, and requires long air runners extending from the supercharger around the engine to the intake passages leading through the engine to the combustion chambers.

Lastly, it is known to position the supercharger on top of the intake manifold above the engine, as illustrated in FIGS. 1(*a*) and 1(*b*). As illustrated in FIG. 1(*a*), a supercharger 248 may be mounted above an intake manifold 266 having runners 270 extending therefrom. The runners 270 extend to intake passages 272 leading through a cylinder head 228, 230 connected to the block 222 of the engine.

This arrangement suffers from the fact that the supercharger 248 extends a great distance "H" beyond the engine, increasing the total engine profile dramatically. Another problem is that the manifold 266 and runners 272 are positioned adjacent the engine, such that the engine heat causes an increase in the temperature of the air flowing therethrough, reducing the efficiency of the engine and negating much of the benefits of the supercharger (thus often necessitating the use of an intercooler as well). Also, because the supercharger 248 is positioned a great distance from the engine, it may require a long drive belt extending from the engine crankshaft to the supercharger drive. The length of the belt and its orientation may reduce the longevity of the belt.

One attempt at reducing the problems associated with the above-stated prior art arrangement is illustrated in FIG. 1(*b*). As illustrated therein, the manifold 266 and its runners 270 have a number of bends, thereby reducing the total distance by which the supercharger 248 extends beyond the engine to a height H' (H' being less than H). Still, however, the supercharger 248 extends well beyond the engine. In addition, the intake manifold 266 and runners 270 are positioned even closer to the engine, and further, the resistive losses are increased by the air's travelling through the curvaceous intake passages.

A "V"-type engine which is supercharged and has its supercharger arranged so that the increase in engine profile is minimized is desired.

SUMMARY OF THE INVENTION

In accordance with the present invention, there is provided a "V" type engine having first and second banks of cylinders and an intake air manifold extending between the two banks of cylinders. The engine includes a supercharger positioned in the valley formed by the two banks of cylinders and below the intake air manifold. The supercharger has an air inlet and an air outlet, the outlet extending generally upwardly from the supercharger to the intake air manifold.

Preferably, the supercharger is oriented with its drive shaft extending outwardly of one end of the engine. A drive belt extends between a pulley driven by the crankshaft of the engine and the drive shaft of the supercharger, whereby the engine drives the supercharger.

Further objects, features, and advantages of the present invention over the prior art will become apparent from the detailed description of the drawings which follows, when considered with the attached figures.

BRIEF DESCRIPTION OF THE DRAWINGS

FIG. 1(*b*) is a partial cross-sectional end view of an engine in accordance with a second prior art arrangement, the engine having a different intake manifold and a supercharger, the supercharger positioned on top of the intake manifold;

DETAILED DESCRIPTION OF THE PREFERRED EMBODIMENTS OF THE INVENTION

Figure 1A:
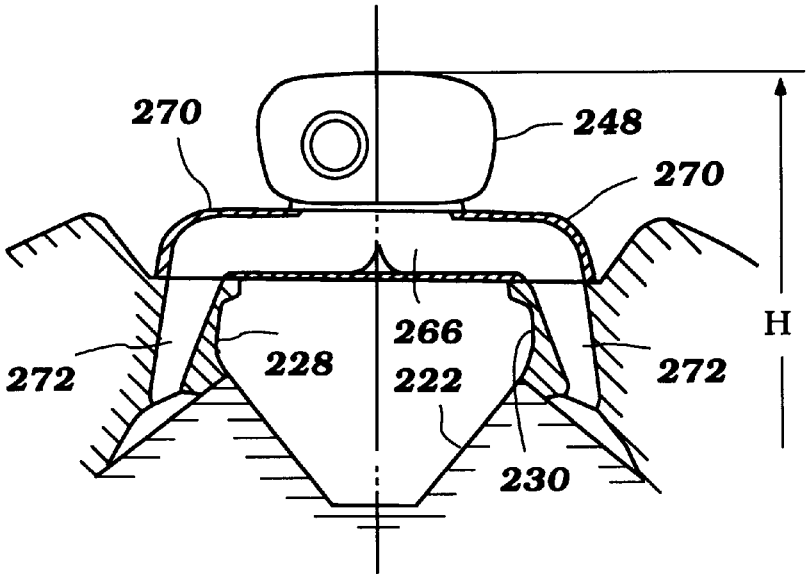
Figure 1(a) (Prior Art)
FIG. 1(*a*) is a partial cross-sectional end view of an engine in accordance with a first prior art arrangement, the engine having an intake manifold and a supercharger, the supercharger positioned on top of the intake manifold.
Figure 1B:
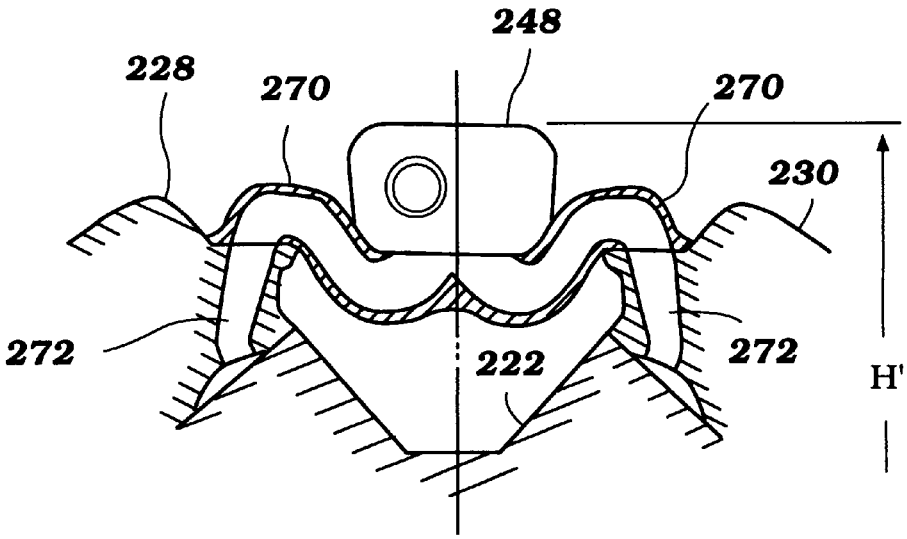
Figure 1(b) (Prior Art)
Figure 2:
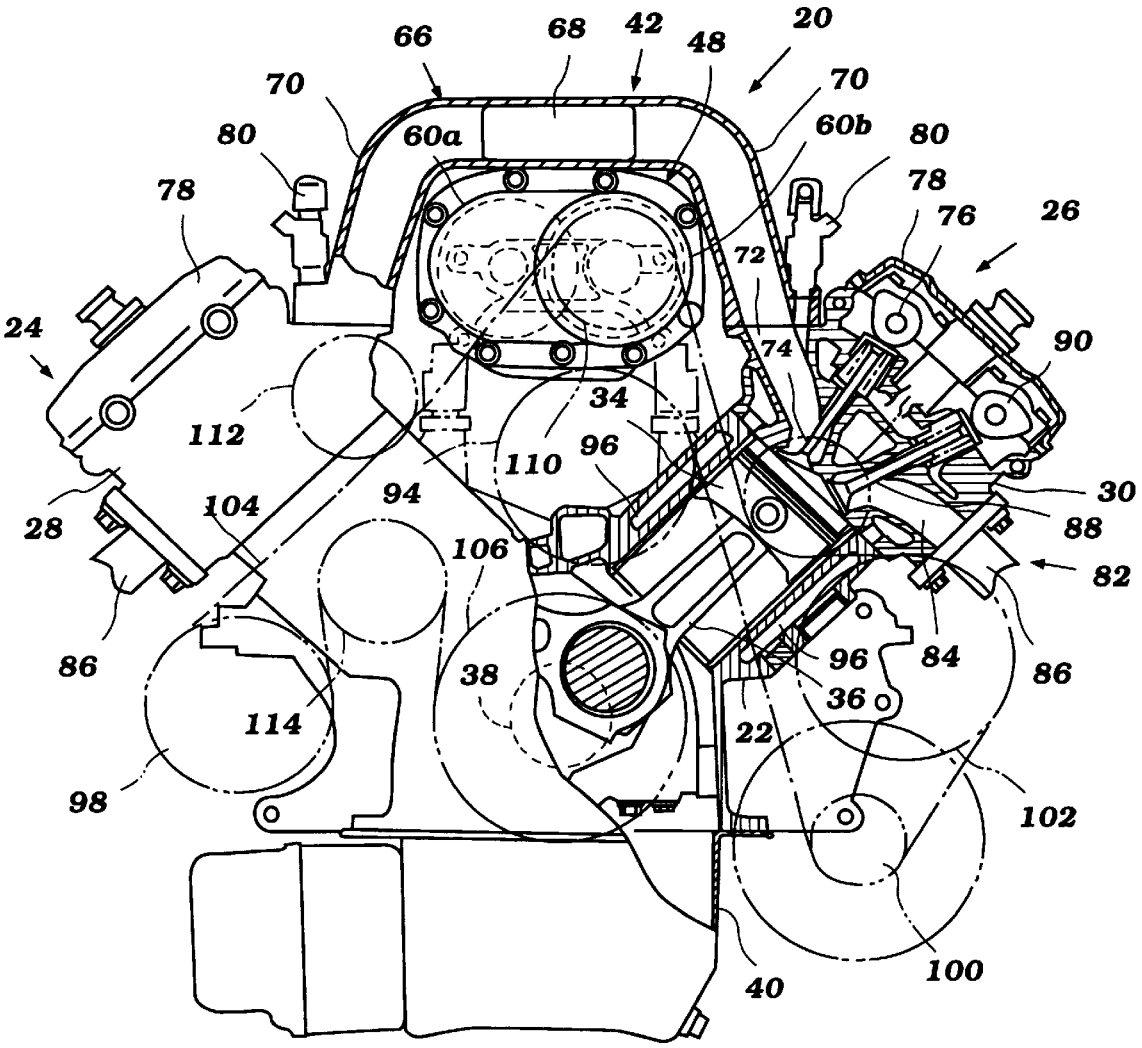
FIG. 2 is an end view, in partial cross-section and with some parts thereof illustrated in phantom, illustrating the supercharged engine in accordance with the present invention.

In accordance with the present invention, and as illustrated in FIG. 2, there is provided a supercharged internal combustion engine 20. The engine 20 is preferably of the "V-8" variety, having a first bank of cylinders 24 and a second bank of cylinders 26 defined by an engine block 22 having first and second cylinder heads 28, 30 connected thereto. The engine block 22 and heads 28, 30 cooperate to define four internal combustion chambers 32 within each bank of cylinders 24, 26. While the engine 20 described and illustrated is of the four-cycle type and includes eight cylinders, it is contemplated that the engine may operate under a two-cycle principal, and/or have as few as one cylinder or more than four cylinders per bank.

A piston 34 is movably positioned within each of the chambers 32. Each piston 34 is connected by a connecting rod 36 to a crankshaft 38. The crankshaft 38 is journalled with respect to the block 22 for rotation with respect thereto, as is well known in the art.

A crankcase cover 40 encloses the crankshaft 38 within the lower or bottom portion of the engine block 22. This cover 40 serves as an oil pan defining an oil sump from which lubricating oil is pumped to the engine, and to which the oil drains, as is well known in the art.

An air intake system 42 is provided for providing air to the combustion chambers 32. The intake system 42 includes an air inlet 44 of an intake plenum 46 (see FIG. 3) which leads to a supercharger 48.

Figure 3:
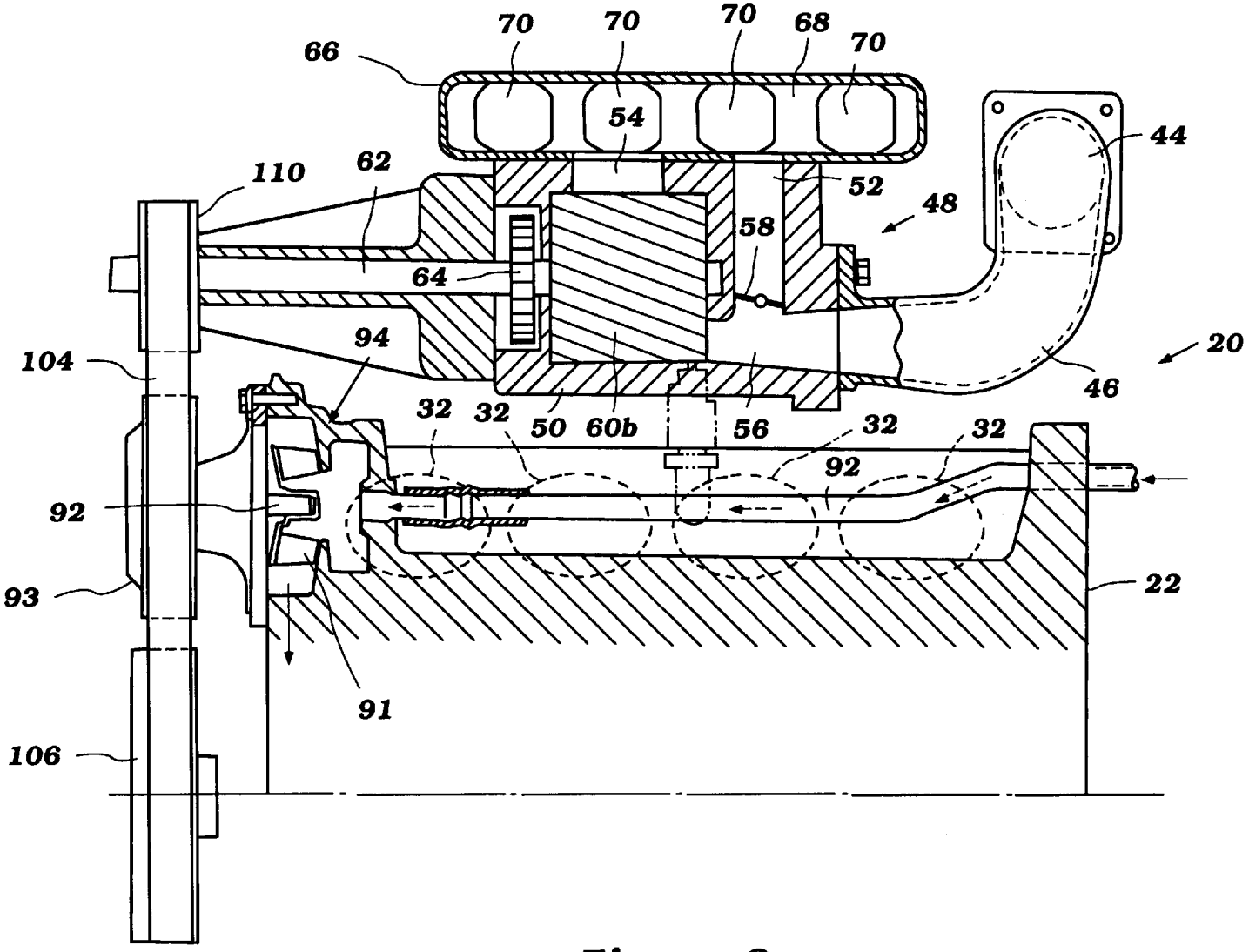
FIG. 3 is a partial cross-sectional side view of the engine illustrated in FIG. 2.

As best illustrated in FIG. 3, the supercharger 48 is of the intermeshing screw type, and has a housing 50 with a pair of air passages 52, 54 therethrough leading from a main inlet 56. The inlet 56 is in communication with the air plenum 46. A first of the passages 52 constitutes a throttled by-pass passage for use in supplying air directly to the engine and bypassing the supercharger 48 under low load conditions as is well known in the art. In particular, a throttle plate 58 is positioned in this passage 52 for controlling the passage of air therethrough for providing air to the combustion chambers when sufficient air is not supplied by the screws of the compressor, or when the compressor screws are not activated (in the case where the supercharger is of the type where the compressor may be selectively turned on and off, such as with a clutch mechanism, as is well known in the art).

A pair of interlocking screw type compressor elements 60*a,b* are positioned in the second passage 54. As illustrated in FIG. 3, a first of these elements 60*a* is driven by a drive shaft 62 extending therefrom. The exact manner by which the drive shaft is driven is disclosed below. The second screw element 60*b* is preferably driven by a timing gear 64 positioned on the drive shaft 62. Both screw elements 60*a,b* are driven in timed rotation to compress air delivered thereto through the main inlet passage 56 through the second passage 54. It should be understood that the supercharger may be of any of a variety of other types, including of the rotating lobe or sliding vane variety.

Figure 4:
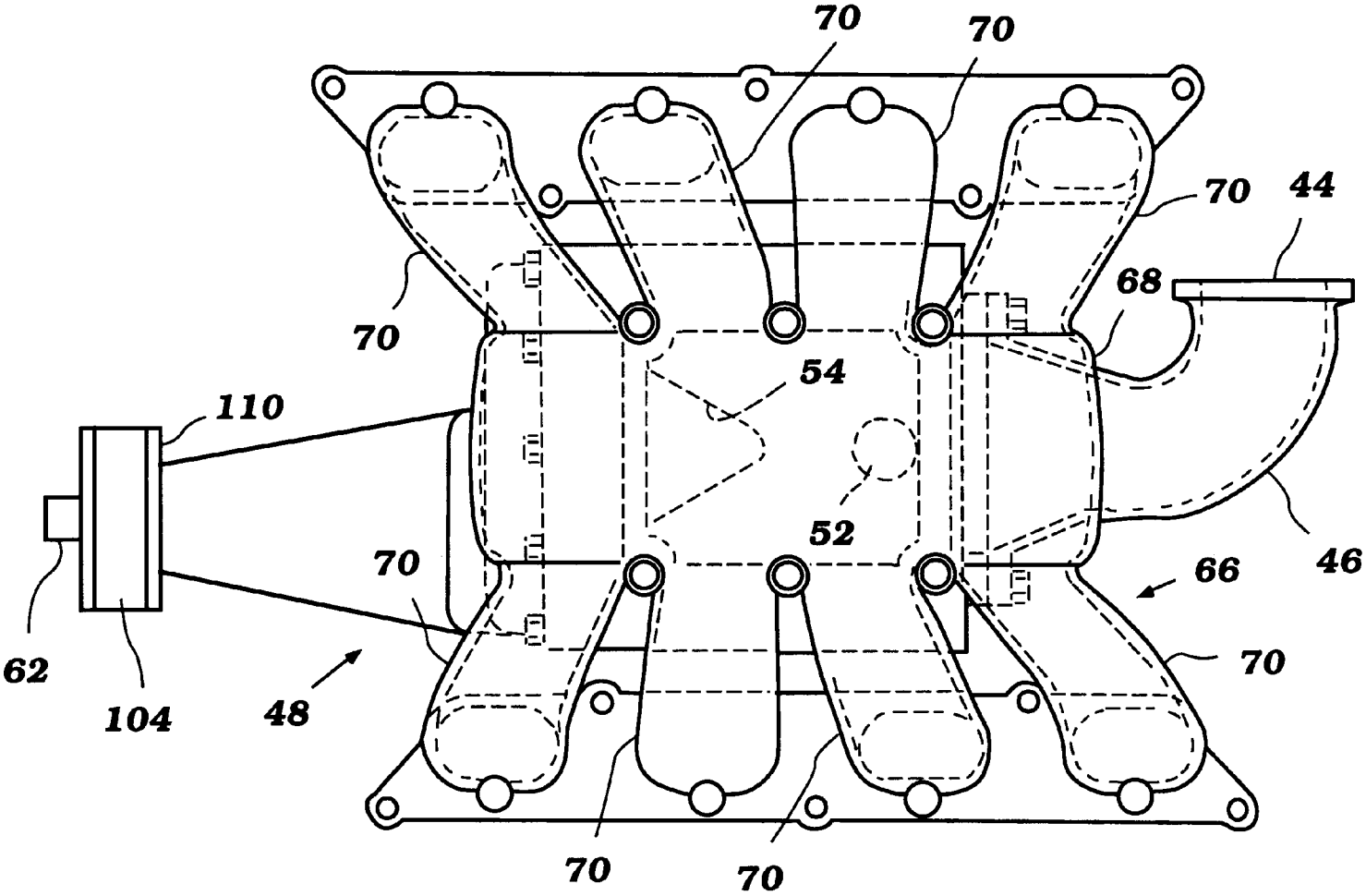
FIG. 4 is a top view of an intake manifold of the engine illustrated in FIG. 2.

As best illustrated in FIGS. 3 and 4, the first and second air passages 52, 54 both lead to an air intake manifold 66. When the supercharger 48 is active and sufficient air is provided by the screws 60*a,b,* the by-pass or throttle plate 58 is closed, and all air supplied to the manifold 66 is delivered under pressure through the second passage 52. In those instances where the supercharger screws are not active or insufficient air is supplied by them, the throttle plate 58 is opened, and air is delivered to the manifold 66 through the first passage 52.

Both passages 52, 54 lead to an inlet of the manifold 66, the inlet preferably leading to a surge tank area 68 of the manifold 66. The surge tank 68 generally has a bottom, opposing sides facing the cylinder heads 28, 30, and a top. The manifold 66 also includes a number of runners 70 leading from the surge tank 68 to each intake air passage 72 leading through the cylinder heads 28, 30 to each combustion chamber 32. As best illustrated in FIGS. 2 and 3, the runners 70 extend generally horizontally outwardly of the sides of the surge tank area 68 (and thus generally perpendicular to the manifold inlet and passages 52, 54) of the manifold 66.

As also illustrated in FIG. 2, each intake air passage 72 is formed within the cylinder head 28, 30. An intake valve 74 is positioned within the passage 72 for use in selectively opening and closing that passage, and thereby selectively allowing air to pass therethrough to the combustion chamber 32. Each intake valve 74 is preferably operated by an intake cam 76. One intake cam 76 is provided corresponding to each of the cylinder banks 24,26 for operating the intake valves 76 corresponding to the cylinders of that bank. As illustrated, a cam cover 78 is provided for enclosing these camshafts 76. A camshaft drive of a type known to those skilled in the art is utilized to drive the camshaft, thus opening and closing the intake valve 74 in a timed fashion.

Fuel is provided for use in the combustion process with a fuel injector 80. Preferably, a fuel injector 80 is provided for injecting fuel into each intake passage 72. The fuel may be supplied to the injectors 80 by a fuel pump from a fuel tank, by a system well known to those skilled in the art.

An exhaust system 82 is provided for routing the exhaust gases produced as a result of the combustion process from each combustion chamber 32. Preferably, the exhaust system 82 includes an exhaust passage 84 leading through the cylinder head 28, 30 from each combustion chamber 32. These passages 84 lead to an exhaust manifold 86 for use in routing the exhaust gasses away from the engine 20, as is well known in the art.

An exhaust valve 88 is mounted within each exhaust passage 84 for use in controlling the flow of gases from each combustion chamber 32 to the exhaust manifold 86. Each exhaust valve 88 is preferably operated by an exhaust camshaft 90. An exhaust camshaft 90 is provided corresponding to each bank of cylinders 24, 26. As illustrated, the exhaust camshafts 90 are also enclosed within the space defined by the top of the cylinder head 38, 40 and the camshaft cover 78. Once again, these camshafts 90 may be driven in any manner known to those skilled in the art.

A coolant system is provided for use in delivering coolant throughout the engine 20. As illustrated in FIGS. 2 and 3, the coolant system includes a coolant or water pump 94 and a number of passages 96 through which the coolant is delivered. The coolant pump 94 has an impeller 91 positioned within a chamber in the engine block 22, the impeller driven by a shaft 92 which extends outwardly of the engine block to a drive pulley 93.

When utilized to power an automobile, the engine 20 preferably includes an air conditioning compressor 98 mounted generally below one of the banks of cylinders 28 and alongside the engine block 22. The engine 20 also includes a power steering fluid pump 102 and an alternator or generator 100, both of which are positioned below cylinder bank 30 opposite the air conditioning compressor 98.

In accordance with the present invention, the supercharger 48, coolant pump 94, power steering pump 102, air conditioning compressor 98 and alternator 100 are all driven by a drive belt 104 which is driven by the crankshaft 38 of the engine 20. As best illustrated in FIG. 2, a drive pulley 106 is driven by an end of the crankshaft 38 extending beyond one end of the engine 20. The drive belt 104 extends from this drive pulley 106 the drive pulley 93 of the coolant pump 94, down to the alternator 100, to the power steering pump 102, around an idler 108, around a drive pulley 110 mounted on the drive shaft 62 of the supercharger 48, to another idler 112, to the air conditioning compressor 98, to a tensioner pulley 114, and back to the main drive pulley 106.

In accordance with the present invention, the supercharger 48 is advantageously positioned within the valley formed by the two banks of cylinders 28,30, and below the intake air manifold 66. The intake air manifold's runners 70 have a small radius of curvature and yet still remain relatively short, so that the effect of air drag is lessened. Also, because the intake air manifold 66 and its runners 70 are positioned outwardly of the supercharger 48, minimal heat is transferred to the air charge which is supplied to the engine 22. At the same time, the overall profile of the engine 20 remains very low even though the engine includes a supercharger.

Figure 5:
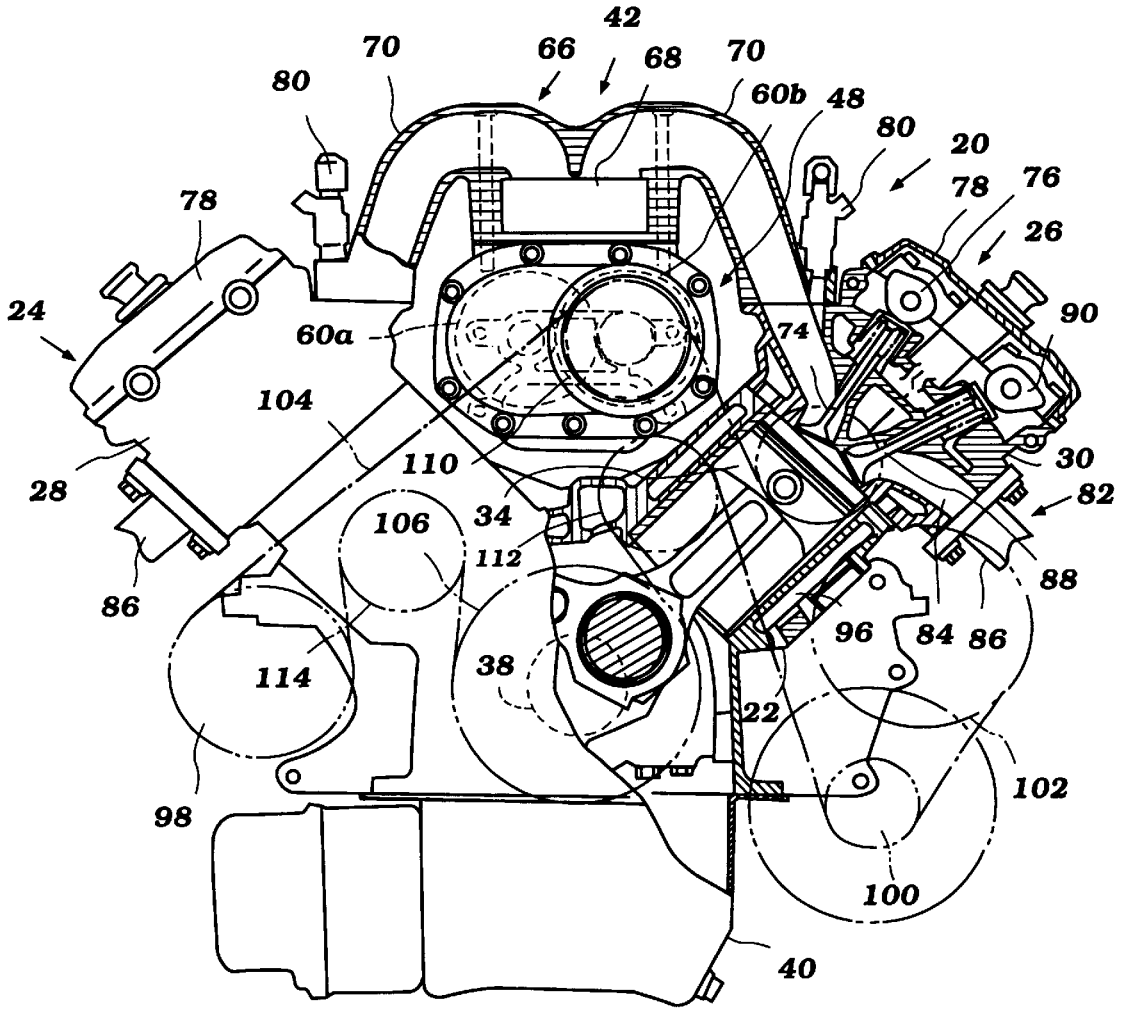
FIG. 5 is an end view, in partial cross-section and with some parts thereof illustrated in phantom, illustrating a supercharged engine in accordance with a second embodiment of the present invention.
Figure 6:
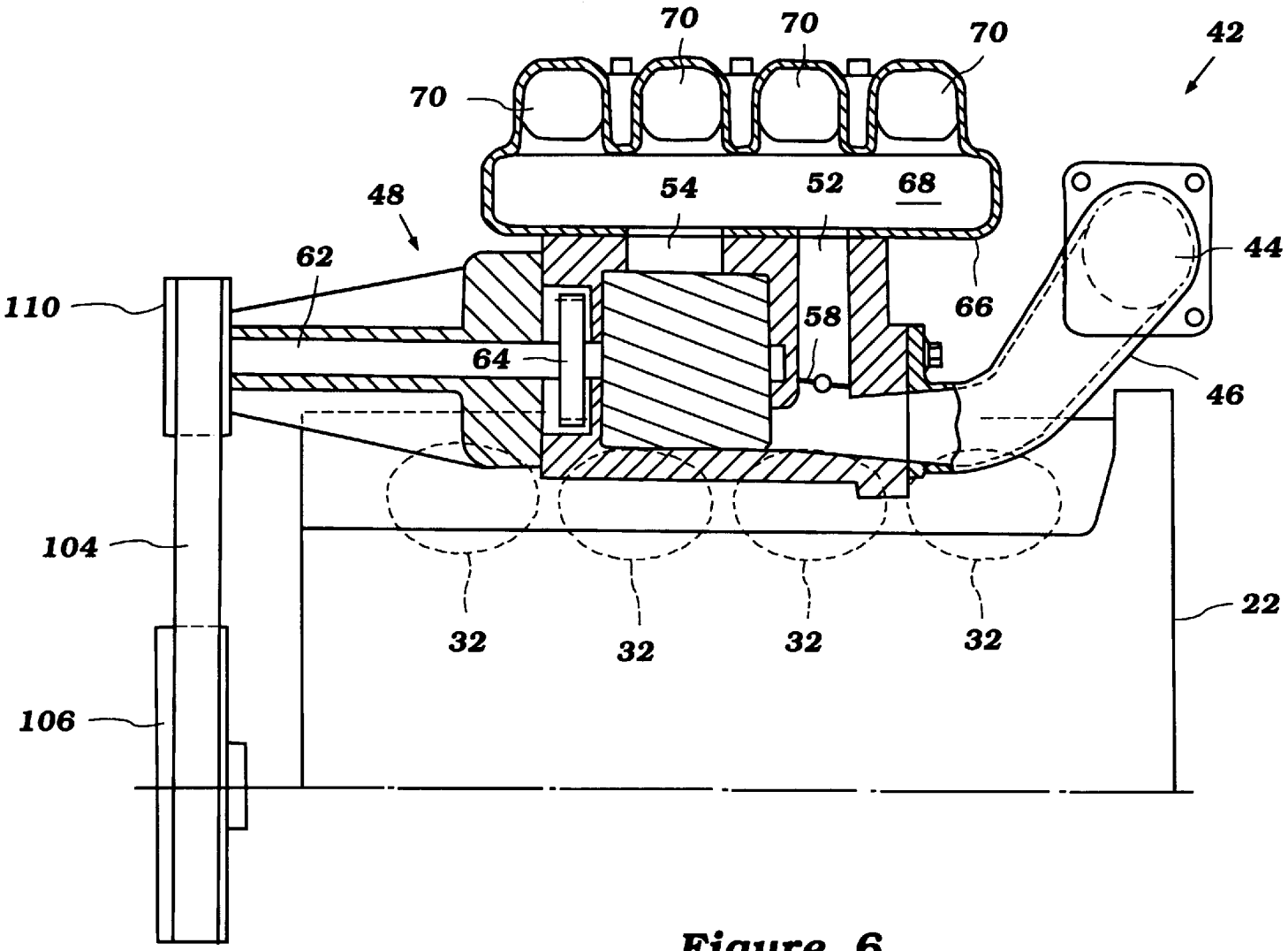
FIG. 6 is a partial cross-sectional side view of the engine illustrated in FIG. 5.
Figure 7:
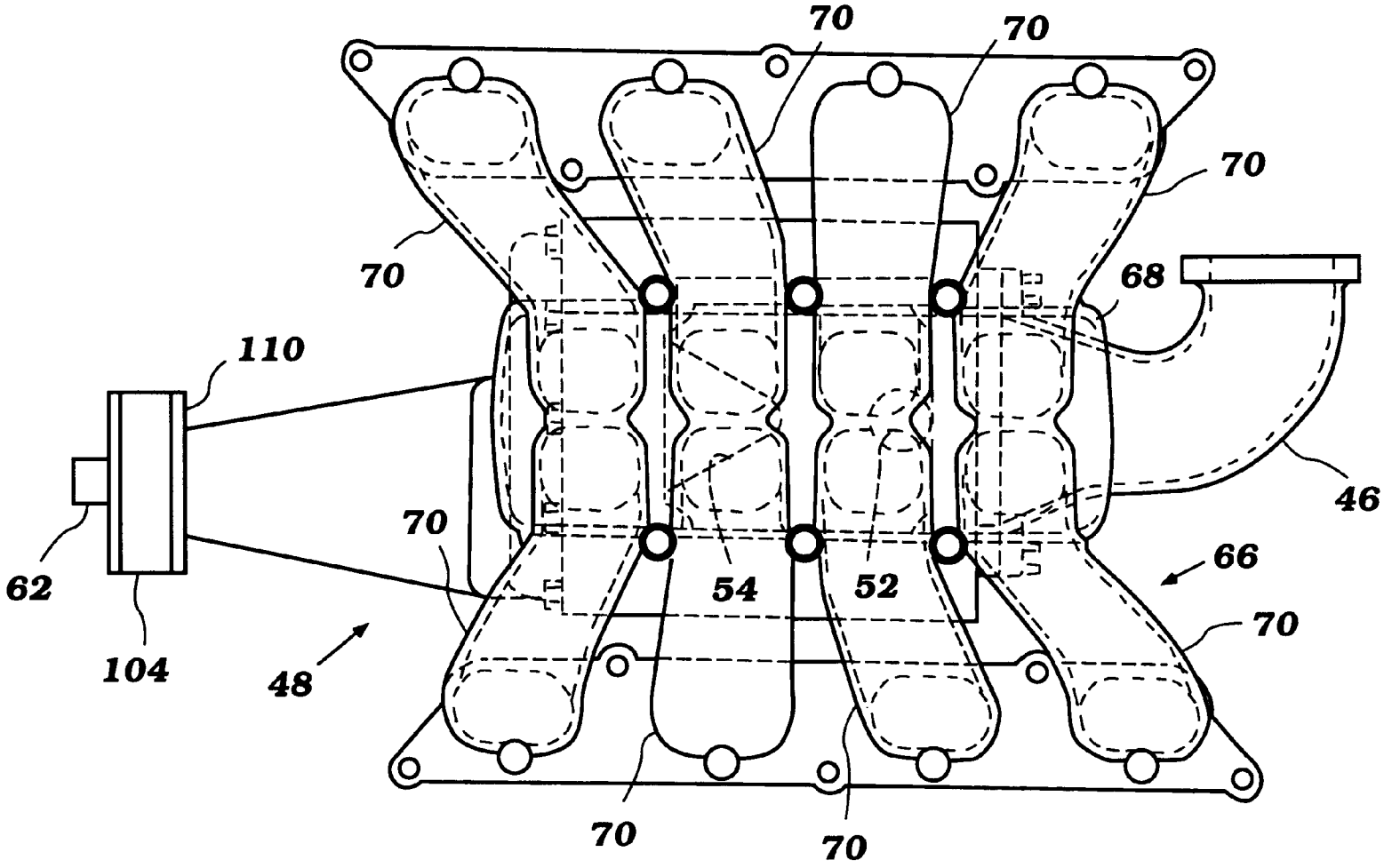
FIG. 7 is a top view of an intake manifold of the engine illustrated in FIG. 5.

FIGS. 5–7 illustrate a second engine embodiment in accordance with the present invention, wherein the same reference numerals are utilized with elements of the engine 20 which are common to those of the first embodiment described above.

As best illustrated in FIG. 5, the runners 70 extend upwardly from the top of the surge tank area 68 of the manifold 66, and then curve downwardly to their connection with the heads 28, 30. In addition, as illustrated in FIGS. 5 and 7, the coolant pump is preferably not positioned at the same end of the engine 20 as the supercharger 48 is driven, as in the first embodiment. In this arrangement, an idler pulley 112 takes the place of the coolant pump 94 in the drive configuration for the supercharger 48 and other engine features. In this embodiment, the re-positioning of the water pump from the same end of the engine 20 as that which the supercharger 48 is driven to another location (such as the opposite end of the engine) permits the supercharger 48 to be positioned closer to the engine 20 (compare FIGS. 2 and 5). This allows the manifold 66 to be of the type which includes a surge tank 68 having runners 70 extending from a top thereof (instead of from the sides), without increasing the profile of the engine as compared to the first embodiment disclosed above.

Of course, the foregoing description is that of preferred embodiments of the invention, and various changes and modifications may be made without departing from the spirit and scope of the invention, as defined by the appended claims.

What is claimed is:

1. A supercharged internal combustion engine having a first bank containing a plurality of aligned cylinders and a second bank containing a plurality of aligned cylinders, said banks being arranged in a "V" orientation and defined by an engine block having a pair of cylinder heads connected thereto each in closing relation to the cylinders of the respective bank, said banks defining a valley therebetween, a piston mounted for reciprocation within each cylinder and connected to a crankshaft which is journalled for rotation with respect to said engine block, a plurality of intake passages each leading through the respective one of said cylinder heads to a respective cylinder of the bank closed by said respective cylinder head, an intake air manifold, said intake manifold having a plenum portion extending longitudinally through said valley in spaced relation to the intersection between the respective cylinder banks, said plenum portion having an inlet disposed in said valley and a plurality of supply passages each leading from the sides of said plenum portion to a respective one of said intake passages leading to a respective one of said cylinders, a supercharger positioned within said valley in the area formed between said banks and said intake manifold plenum portion, said supercharger having an air intake formed at one longitudinal end of said valley and an air outlet formed within said valley and communicating with said inlet of said manifold plenum portion, said supercharger having a pair of intermeshing rotors rotating about parallel axes extending longitudinally of said valley, a valved bypass passage formed in said supercharger within said valley at said one longitudinal end and within said valley for selectively communicating inducted air from said supercharger air intake to said plenum portion bypassing said intermeshing rotors, and means for driving said supercharger at the other longitudinal end of said valley.

2. The engine in accordance with claim 1, wherein said means for driving comprises a drive pulley positioned on a portion of said crankshaft extending outwardly of said engine, a pulley mounted upon a drive shaft of said supercharger, and belt driven by said drive pulley and driving said pulley mounted on said drive shaft.

3. The engine in accordance with claim 2, wherein said engine includes a coolant pump, said coolant pump being positioned at said other end of said valley, said coolant pump having a pulley connected to a drive shaft thereof, said pulley being driven by said drive belt.

* * * * *